United States Patent [19]

Guzzoni

[11] Patent Number: 4,574,573

[45] Date of Patent: Mar. 11, 1986

[54] PNEUMATIC SPLICER FOR TEXTILE YARNS

[75] Inventor: Gianfranco Guzzoni, Puegnago, Italy

[73] Assignee: Mesdan S.p.A., Salo, Italy

[21] Appl. No.: 652,068

[22] Filed: Sep. 19, 1984

[30] Foreign Application Priority Data

Oct. 7, 1983 [IT] Italy ..... 23191/83[U]

[51] Int. Cl.[4] ..... B65H 69/06; D01H 15/00; D02J 1/08

[52] U.S. Cl. ..... 57/22

[58] Field of Search ..... 57/22, 23, 261

[56] References Cited

U.S. PATENT DOCUMENTS

| | | | |
|---|---|---|---|
| 4,344,277 | 8/1982 | Rohner et al. | 57/22 |
| 4,411,128 | 10/1983 | Mima | 57/22 |
| 4,437,298 | 3/1984 | Truzzi et al. | 57/22 |
| 4,437,299 | 3/1984 | Truzzi et al. | 57/22 |

*Primary Examiner*—John Petrakes

*Attorney, Agent, or Firm*—Cushman, Darby & Cushman

[57] ABSTRACT

A device for jointing, by means of compressed air, textile yarns and for preliminarily preparing the ends of the yarns to be jointed is provided, in particular for being installed on textile machinery, such as spoolers.

In order to achieve minimum overall dimensions of the device, and to the purpose of constructing it in a simple and cheap way, the device comprises a central body (10, 11, 12) bearing a head (26) in which a mixing chamber (27) is provided, two walls (15, 16) positioned opposed to each other and spaced apart from the two outside surfaces of the body perpendicular to the axis of the chamber (27), and two contoured plates (21, 22), with profiled slots (78, 79) slidingly assembled between the outside surfaces of the central body, and the relevant spaced apart wall. The plates (21, 22) are driven to perform linear movements and drive, by means of their slots, the synchronous movements of the moving gears of the device (FIG. 2).

9 Claims, 7 Drawing Figures

PNEUMATIC SPLICER FOR TEXTILE YARNS

The present invention relates to a device for jointing, by means of compressed air, textile yarns, and for preliminarly preparing the ends of the yarns to be jointed, particularly intended for being installed on spoolers and similar textile machinery.

Devices of this type are known as embodied in different structures, and they have been lately replacing more and more the conventional knotters, thanks to their ability to joint the textile yarns without knots, and to the fact that they have presently reached a very high level of improvement and of reliability, so that these devices can nowadays be used for the most of the textile yarns, both from natural, and from man-made or blended fibres.

These devices comprise, generally, a blending chamber in which the ends of the yarns, suitably preliminarly prepared in order to opening and parallelling the fibres, are submitted to the action of at least one stream of compressed air, to the purpose of obtaining the blending, braiding and mutual entwisting of the fibres of the two yarns, and hence their jointing. The devices are moreover equipped with suitable means for introducing inside the blending chamber, right positioning, and cutting the free extremities of the yarns to be jointed, with means for pretreating, as hereinbefore mentioned, the ends of the yarns after the free extremities have been cut away, with valve means for controlling the feeding of compressed air first to the pretreatment means of the ends of the yarns and then to the blending chamber, as well as with means for controlling the various means to operate in the proper sequence, said means being normally connected to a suitable power source of the spooler, which generally supplies a reciprocating rectilinear motion, which can be transformed, if necessary, into a continuous rotary motion.

The various structures already known of these devices, even if they are rather excellent from the mechanical point of view, and although they secure a satisfactorily reliable running, are generally very complex structurally, require high precision working, and have quite large overall dimensions.

The purpose of the present invention is therefore mainly to provide a device of the type described, with simpler and cheaper structure than the devices presently known, which encloses within a single unit, directly applicable to the spooler or similar machinery, all necessary means for proper operation, and has minimum overall dimensions, so to allow it to be installed in available spaces of reduced dimensions.

It has to be pointed out that the device according to the present invention is intended for being installed on a spooler or similar machinery, equipped with means for the automatic search of the ends of the yarn to be jointed, and for positioning such ends to be jointed on opposite sides of the jointing device, such means being known per se, and being normally present in the mentioned textile machinery.

In view of the hereinbefore outlined purpose, the present invention provides a jointing device, substantially comprising a central body bearing at one of its ends an head, within which the blending chamber is formed, provided with a longitudinal slit for the introduction of the yarns, two walls mounted opposite to each other, and spaced apart from the two outside faces of said body perpendicular to the longitudinal axis of said blending chamber, guide means on said walls and on said outside faces of the body to the purpose of positioning the yarns to be jointed, arriving from opposite sides, inside the blending chamber, clamping means and cutting means of the free extremities assembled on said faces, a cap for closing the longitudinal slit of the blending chamber oscillatingly mounted on said body, two shaped driving plates provided with profiled slots slidingly assembled between each one of said outside faces of the central body and the relevant spaced apart wall, and fitted to carry out, upon external driving, reciprocating rectilinear motions of predetermined length in order to driving synchronously and in the desired sequence the motions of the movable components of said clamping means, of said cutting and introducing means of the yarn extremities, and of said cap, as well as the opening and the closing of valve means situated in said central body for the delivery of compressed air both to pretreatment nozzles located laterally to the central body, correspondingly to the lateral open outlets of the blending chamber, and to nozzles located in said chamber itself.

Further characteristics and advantages of the device according to the present invention will appear in greater detail from the following detailed disclosure of an embodiment, with reference to the drawings, in which.

Figure 1:
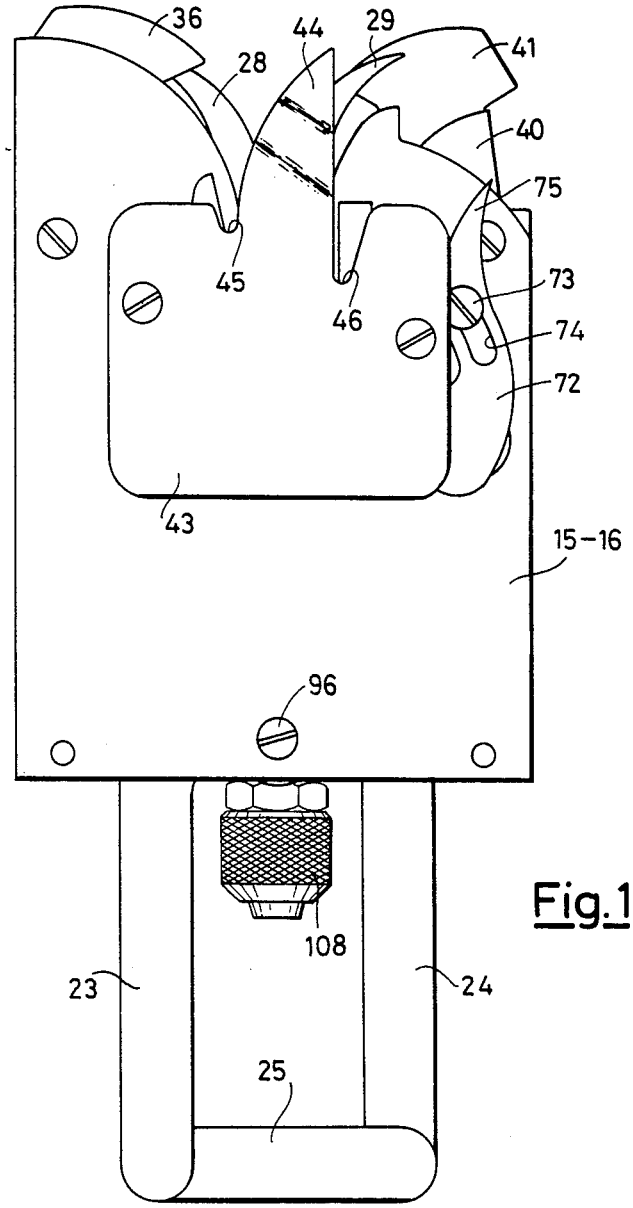
FIG. 1 is a lateral external view of the device.

The device shown in the drawings comprises a central body consisting of a prismatic portion 10, of a cover 11 and of a base 12. This body is surrounded at a certain distance by two side walls 13 and 14 and by two front walls 15 and 16, fastened to said cover 11 and to said base 12. Within the gaps between the side walls 13, 14 and the relevant side faces of the prismatic portion 10 of central body, guide columns 17 and respectively 18 are placed, for slides 19 and respectively 20, to which two plates 21, 22 are fastened, able to travel linearly inside the gaps between the front walls 15, 16 and the relevant front faces of the prismatic portion 10 of the body. The two plates 21, 22 extend in their lower part into bars 23 and resp. 24, connected to each other by an element 25 on which an external (not shown) means is fitted to act to the purpose of causing the plates 21, 22 and the slides 19, 20 to carry out linear to-and-fro strokes of predetermined length.

On the cover 11 of the body, a head 26 is mounted, in which the blending chamber 27 is formed, said chamber being open at both its ends, and being provided with an upper longitudinal slit for the introduction of the yarns to be jointed. The longitudinal axis of chamber 27 is perpendicular to the outside front faces of the prismatic portion 10 of central body and to the front walls 15, 16 parallel to said faces.

Onto the front outside faces of the central portion 10 of the body, laterally to the outlets of the blending chamber 27, guide means 28, 29 and resp. 30, 31 are fastened, sickle-shaped, whose purpose is of guiding the yarns during their introduction and positioning within the blending chamber.

Figure 3:
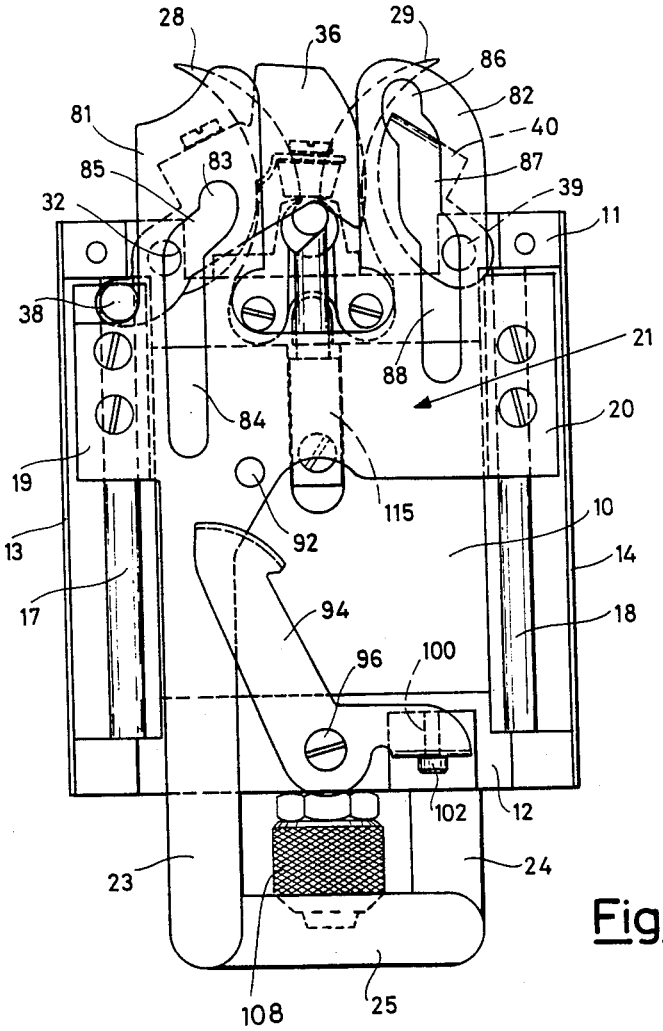
FIG. 3 is a view similar to FIG. 2, in another operating position.

On the cover 11 a bracket 33 is mounted, rotatably around a pivot 32 parallel to the axis of chamber 27, said bracket 33 bearing a cap 34 fitted to lean against the head 26 to the purpose of closing from upward the blending chamber 27, i.e., its longitudinal open slit, said bracket 33 being constrained by a (not shown) spring to take a position in which the cap 34 is spaced apart from the head 26. Around the bracket 33 a second bracket 35, it too being rotatable around the pivot 32, but with the possibility of a slight spring angular motion relatively to the first bracket 33. The second bracket 35 bears on one side a small contoured plate 36 which, with the cap 34 being placed against the head 26, is positioned laterally to the sickle-shaped guide elements 28, 29 barring from upward, by means of its lower edge 37, the passage between these two elements 28, 29 (see FIG. 3). A lower extension of said platelet 36 supports moreover a pivot with driving roller 38.

On the opposite side of the head 26 relatively to the pivot 32 another pivot 39 is provided parallel to the first one, it too being supported by the cover 11, around said pivot 39 a bracket 40 being rotatably mounted similar to bracket 35, said bracket 40 being constrained by a spring, not shown, to take a lifted position (like that of bracket 35), and on one side provided with a shaped platelet 41 which, when the bracket 40 is lowered, moves to a lateral position relatively to the guide elements 30, 31, thus performing the same function as the contoured platelet 36 of the bracket 35. A lower extension of platelet 41 supports a pivot with driving roller 42.

The front walls 15 and 16 support the clamping means, the cutting means and means for the introduction of the free extremities of the yarn inside the blending chamber after they have been pretreated, and before they are jointed. All these means are identically and symmetrically provided both on the wall 15 and on the wall 16, for this reason only those assembled on wall 15 shall be described now.

To the outside of the wall 15 a shaped plate 43 is fastened by means of spacers, such plate 43 having an upper central part pointedly shaped 44, on both sides of which two grooves 45, 46 being provided with different depth, whose purpose is of guiding, together with the sharp part 44, and positioning the yarns during their introduction to the device.

Figure 5:
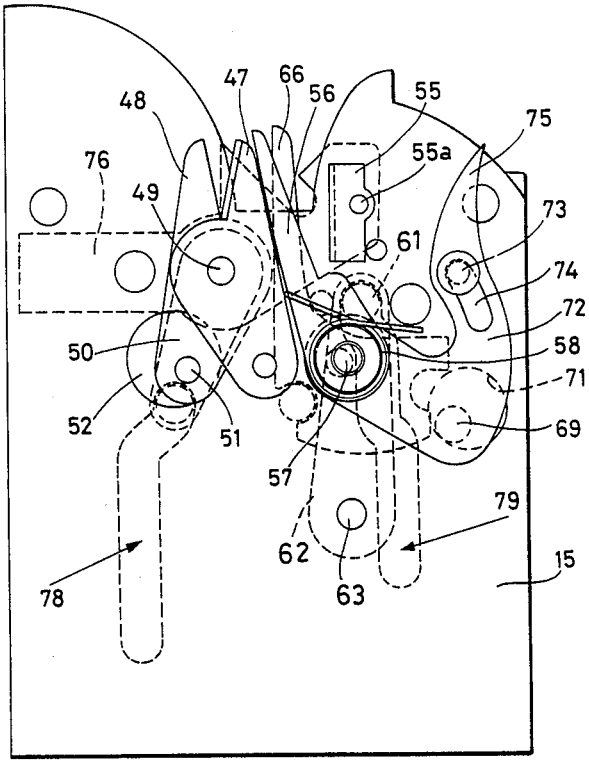
FIG. 5 is an external view of the wall removed in FIG. 2, in which a protection plate has been removed.
Figure 6:
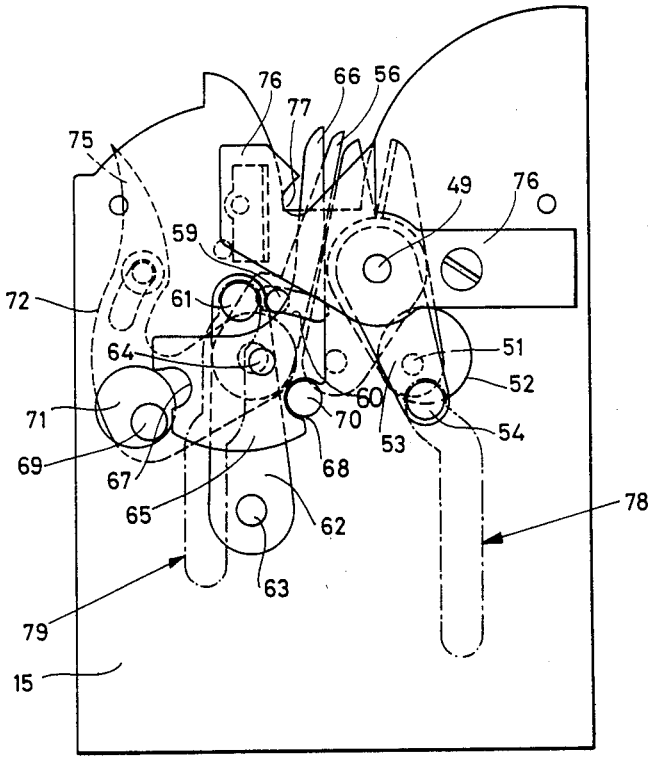
FIG. 6 is an interior view of the wall shown in FIG. 5.

In FIG. 5 the wall 15 is shown as viewed from the outside, the shaped plate 43 having been removed, whilst FIG. 6 shows the same wall dismantled from the device, and viewed from the inside.

On the outside of wall 15 and between it and the relevant contoured plate 43, the clamping means and the cutting means are shown (FIG. 5). The cutting means comprise a fixed knife 47 and a movable knife 48, which is rotatably assembled around a pivot 49. An extension 50 of movable knife 48 bears a pivot 51 which penetrates through a window 52 towards the inner side of wall 15 (FIG. 6), where it is fixed to an arm 53, rotatable around the same rotation pivot 49 of the movable knife 48. The arm 53 in its turn bears a pivot with driving roller 54.

The clamping means consist of a fixed part 55 which can be oriented around a pivot 55*a*, equipped with a V shaped groove and of a movable part 56 rotatably assembled around a pivot 57, and constrained by a spring 58 to enter the groove of the fixed adjustable part 55. The movable part 56 bears a pin 59 which penetrates through a window 60 towards the inner side of wall 15 (FIG. 6), where it cooperates with the end of a lever 62 rotatable around a fixed pivot 63. The same end of lever 62 supports a pivot with driving roller 61 and is fitted to push the pin 59 and hence the movable part 56 of clamping means against the force exerted by the spring 58, so as to cause the movable part 56 to go out of the fixed part 55 and to position itself spaced apart from it.

On a central pivot 64 of the lever 62 a shaped element 65 freely rotatably is mounted, which has an upper pointedly shaped extension 66, and two lower semicircular notches 67 and 68 fitted to cooperate with two pivots 69 and resp. 70, the first of which being adjustable, and the second being fixed. The adjustable pivot 69 penetrates through a window 71 of the wall 15, and on the outside of it, it is fixed to a shaped element 72 (FIG. 5), rotatably mounted around the pivot 57 and suitable to be blocked by a screw 73 on the wall 15. This blocking screw 73 traverses a slot 74 of element 72, and allows the element 72 to be angularly adjusted around the pivot 57, and hence the pivot 69 to be angularly adjusted inside window 71. A pointed end 75 of element 72 acts as a pointer to show the position of pivot 69. According to this positioning of pivot 69, the shaped element 65 with its pointedly shaped extension 66 is able, due to the cooperation of the pivot 69 with the notch 67 and of the fixed pivot 70 with the notch 68, to carry out longer or shorter strokes, with the same angular shift of the lever 62 caused by the pivot with driving roller 61. The pointedly extension 66 of the shaped element 65 cooperates with a spring element 76, having a shaped nick 77 for positioning the yarn, for sligthly pinching the yarn itself and it is additionally useful, in the second adjustable portion of its stroke, to the purpose of prolonging the path of the yarn itself, for introducing to a larger or lesser extent the free end of the yarn inside the blending chamber, which is placed on the opposite side of the chamber itself.

It must be considered that, as the walls 15, 16 and the devices assembled on them are perfectly symmetrical, on each one of the two yarns to be jointed, which are introduced inside the blending chamber 27 and are arriving from opposite sides, in correspondence of the introduction side the clamping means 55–56 and the extremity introduction means 66, and in correspondence of the opposite side, the cutting means 47–48 are active.

To the purpose of driving in the proper sequence the synchronous motions of the movable parts of said devices, of the couple of brackets 33–35 with the cap 34, and of the bracket 40, the driving plates 21 and 22 are active, to which—as it has been previously explained—a linear reciprocating motion can be conferred by means of an external equipment.

To this purpose, the plates 21 and 22 are suitably contoured and are each equipped with two contoured slots 78, 79.

Due to the symmetrical configuration of the whole device, the two plates 21 and 22 are identical to each other, and are symmetrically assembled within the free gaps between the front walls 15, 16, and the relevant exterior surfaces of the central body. For this reason, one of such plates shall be described hereunder, and namely, the sliding plate 21.

The plate comprises a base portion 80 by means of which it is fastened to the slides 19, 20, and two upper parallel extensions 81, 82 spaced apart from each other. The profiled groove 78 extends partly inside the extension 81 and inside the base portion 80, whilst the profiled groove 79 extends partly inside the extension 82 and inside the base portion 80.

The general arrangement of the two grooves 78, 79 is parallel to the direction of the linear stroke of the plate 21. The groove 78 has a rectilinear portion 83 closer to the centre of the plate, a straight portion 84 farther from the centre and an oblique portion 85 joining the two. Inside the slot 78 the pivot with driving roller 54 solid with the mobile knife 48 of the cutting means is housed. When the roller 54 is inside the portion 83 of the groove 78, the cutting means are open, when it is inside the portion 84 they are closed, and when it runs inside the oblique portion 85, it causes the closure and the cutting.

The groove 79 has three straight portions 86, 87, 88 parallel to the motion direction of the plate 21, progressively farther from the centre of the plate itself, and joined by respective oblique portions. Inside the groove 79 the pivot with driving roller 61 is inserted. When the roller 61 is inside the portion 86, the clamping means 55–56 are open and the means 66 is shifted, so as to make free the nick 77 of the element 76. When the roller 61 passes inside the portion 87 of the groove 79, the movable part 56 of the clamping means is allowed to be pushed by the spring 58 inside the groove of the adjustable fixed part 55 so as to firmly clamp the yarn, while the means 66 slightly pinches the yarn cooperating with the element 76. Finally, when the roller 61 passes inside the portion 88 of the groove 79, while the means 55–56 remain in the clamping position under the action of the spring 58, the means 66 is made to further shift, its stroke being adjustable as previously set forth, in order to introducing to the blending chamber 27 the free end of the relevant yarn.

The plate 21 is additionally provided with a further cam profile, and namely the upper and external edge of its extension 81, with which edge the pivot with driving roller 38 cooperates. With the analogue cam profile of plate 22 the pivot with driving roller 42 cooperates on the contrary.

The upper portion 89 of said cam profile is inclined from the centre towards the outside and leads then to the lateral exterior portion 90 which is parallel to the linear moving direction of the plates 21 or 22. When rollers 38 and 42 are in contact with the upper portion 89 of the cam profile of the plates 21 and 22, the couple of brackets 33–35 with the cap 34 and the bracket 40 are in a lifted position, and as said rollers run downward along said upper portion, said brackets are shifted to their lower portions and the cap 34 is elastically pressed, due to the resilience of the bracket 33, against the head 26, thus closing the longitudinal slit of the blending chamber. The lateral portion 90 of the profile of plates 21 and 22 holds then the rollers 38 and 42 in the position in which the relevant brackets and the cap are lowered.

It must be pointed out now that in the described structure, the useful working stroke of the plates 21 and 22 is that from down upward, as seen in the FIGS. of the drawings, whilst the stroke from up downward is simply a return stroke.

The two plates 21 and 22 have finally a further purpose, namely of driving two valves for feeding compressed air respectively to pretreatment nozzles of the ends of the yarns to be jointed, and to the blending chamber for the very jointing operation.

To this purpose, eachone of the plates 21 and 22 is provided with a driving pivot 91 and resp. 92 protruding towards the outside of the relevant plate, and fitted to act on an arm 93 and resp. 94 of a double arm lever, fulcrumed in 95 and resp. 96 to the base portion 12 of the central body of the device, the other arm 97 and resp. 98 of said lever being fitted to act on the stem 99 and resp. 100 of distinct valves which will be described later on. A spring (not shown) constrains each double arm lever in such a way as to hold the fork end of arm 97 and resp. 98 in contact with a head 101 and resp. 102 formed on the stem 99 and resp. 100.

In particular, the pivot 91 of the plate 22 is fitted to cooperate with an inclined folded end tongue of the arm 93 and pivot 92 of plate 21 cooperates with an inclined folded end tongue of arm 94, said inclined folded tongues being placed, with the relevant two arm lever being in its resting position, on the trajectory of the pivots 91 and 92.

As the compressed air must be fed, during the operative cycle of the device, first to the pretreatment nozzles and only subsequently into the blending chamber, the pivot 91 on the plate 22 is positioned so as to act on the arm 93 before the pivot 92 on the plate 21 acts on arm 94, the stem 99 being the one pertinent to the valve which controls the feeding of compressed air to the pretreatment nozzles, and the stem 100 being the one pertinent to the valve which controls the feeding of compressed air to the blending chamber.

The length of the opening time of these valves is primarily defined by the interference time, during the operative stroke of plates 21, 22, of the pivots 91,92 with the inclined folded tongues of the lever arms 93 and resp. 94. As, in the case being considered, the pretreatment time of the yarn ends is lower than the longest foreseen time for the jointing operation under the effect of the stream of compressed air in the blending chamber 27, the tongue of arm 93 is shorter than the tongue of arm 94.

During the interference between the pivot 91 or 92 with the tongue of arm 93 or 94, during the operative stroke of the plates 21 and 22, the relevant double arm lever is made to rotate in such a direction as to cause the stem 99 or 100 to go out from the valve body in order to opening the pertinent valve. Also during the return stroke of the plates 21 and 22, the pivots 91 and 92 interfere with the folded tongues of arms 93 and 94, but the slope of said tongue is such as to cause during such return stroke an idle rotation in opposite direction of the double arm levers, without actuating the stems 99 and 100 of the valves. This idle counter-rotation is possible because the stems 99 and 100, in the closing position of the valves, are partly outside from valve body, and they must be further extracted in order to opening the valves.

Figure 7:
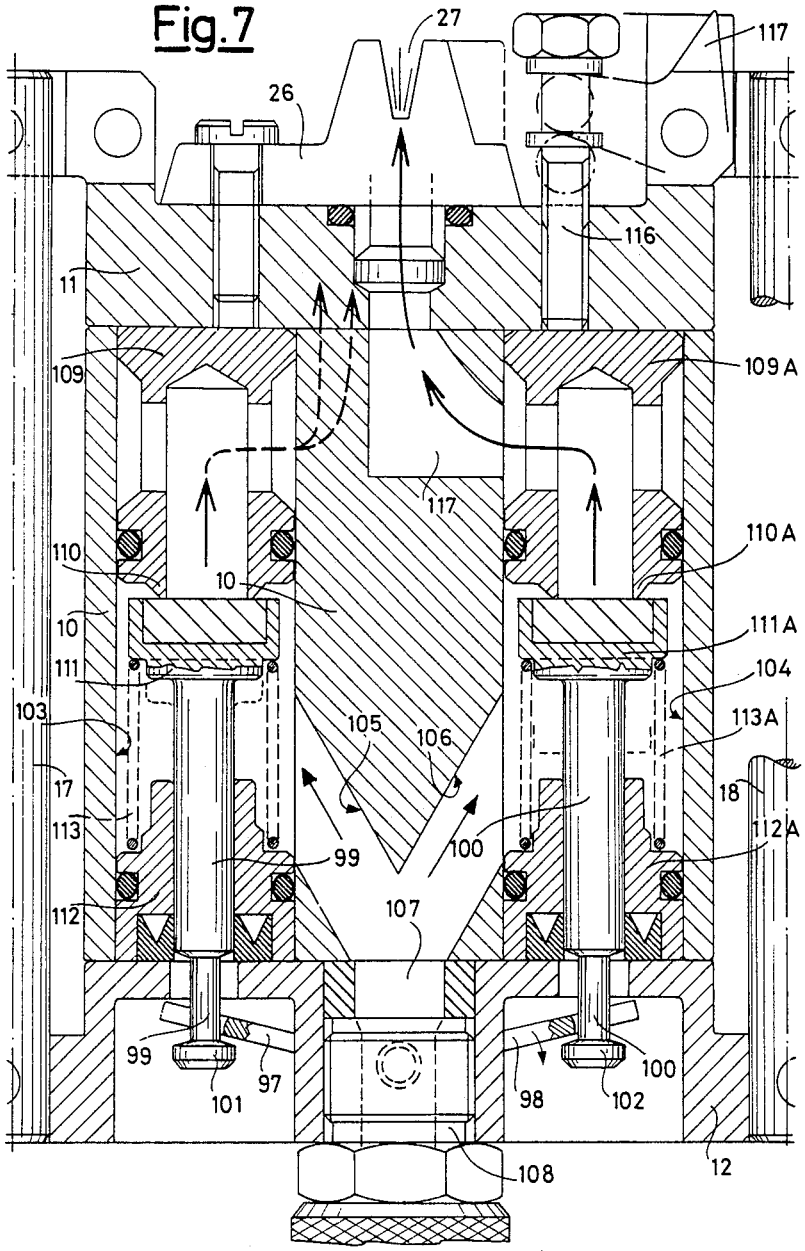
FIG. 7 is a sectional view through the body of the device, on a plane perpendicular to the longitudinal axis of the blending chamber.

Referring now to FIG. 7, the valve body will be now described in greater detail. This body is formed by the prismatic portion 10 of the central body, in which two through bores are provided parallel to each other, 103 and 104, which are the housings for the two valves. Two divergent channels 105 and 106 connect the holes 103 and 104 with a common inlet 107 to which a nipple 108 is connected, fitted to be joined to a source of compressed air.

Figure 2:
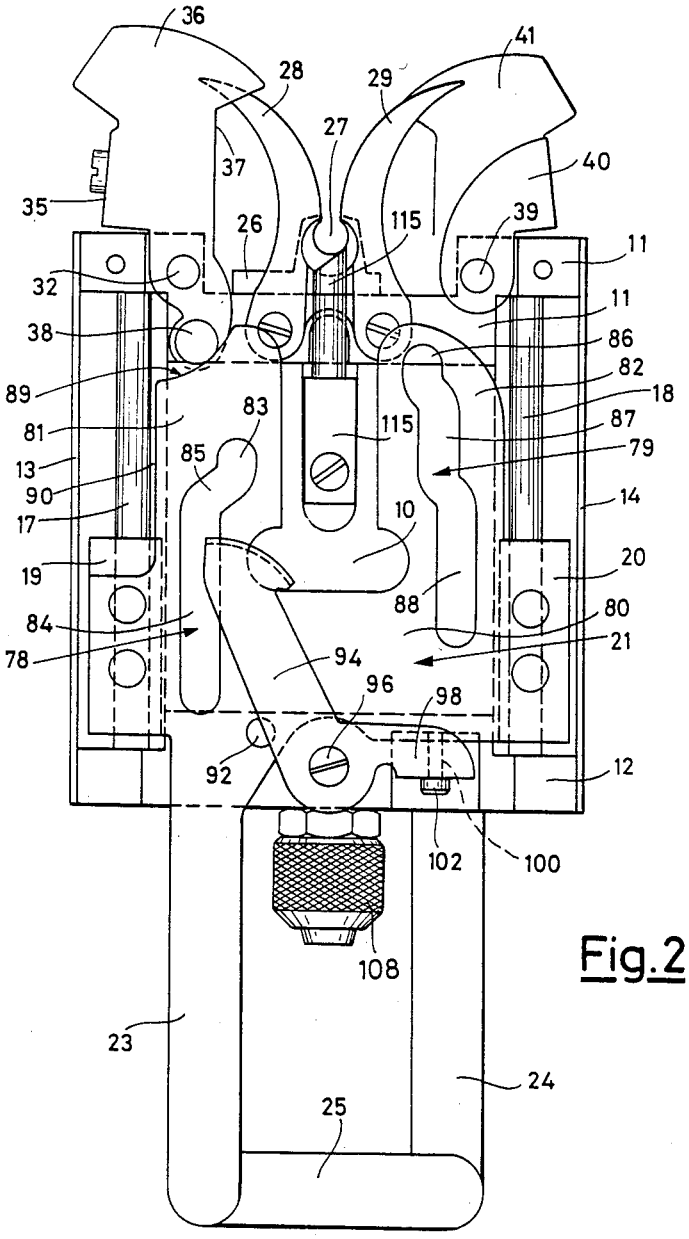
FIG. 2 is a view of a side of the device, with the relevant wall having been removed, in an operating position.
Figure 4:
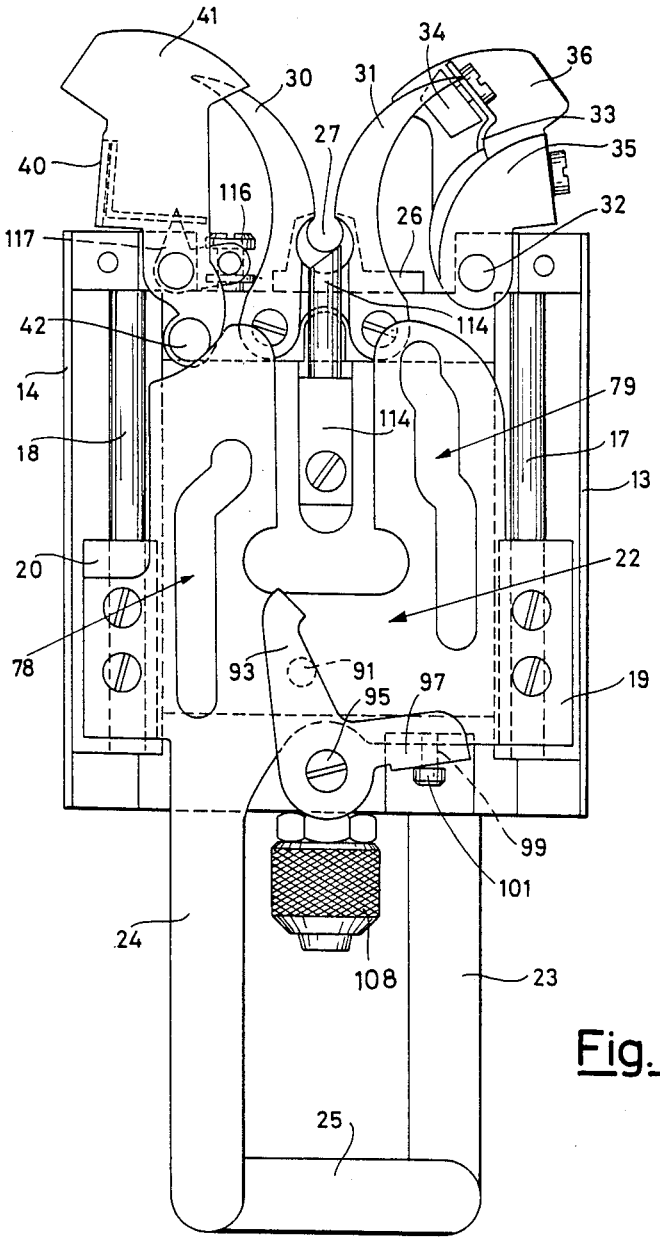
FIG. 4 is a view similar to FIG. 2, of the opposite side of the device.

Inside the bore 103 are inserted, in series from up downward, an upper tubular blind body 109 forming with its lower edge 110 the seat of the valve, a valve head 111 supported by the upper end of the stem 99, and a lower tubular body 112 axially tightly traversed by the stem 99. A spring 113 acting between the lower body 112 and the valve head 111 holds the latter pressed against the valve seat 110. It must be noticed that the bodies 109 and 112 are kept inside the bore 103 respectively by the cover 11 and by the base 12 of the central body of the device. The upper body 109 connects, through radial openings, its blind bore with channels not shown, formed in the prismatic portion 10, such channels originating from the upper part of the bore 103 and leading to the pretreatment nozzles 114 and 115 (see FIGS. 2 and 4) assembled on the front surfaces of prismatic body 10 in correspondence of the lateral outlets of the blending chamber 27. It appears clearly that, by lowering the stem 99 with the valve head 111, against the action of the spring 113, compressed air, always present inside the channel 105 and in the region of bore 103 between the valve head 111 and the lower body 112, can be fed to the pretreatment nozzles 114 and 115 for the proper preparation of cut free ends of yarns, which protrude laterally from the blending chamber 27.

The valve inserted inside the second bore 104 of the prismatic portion 10 is composed by parts similar to those forming the valve inserted inside the bore 103. These parts are indicated by the same reference numbers, followed by the letter "A". The only difference relatively to the valve of bore 103 is that the upper body 109A can be displaced from its position in which its upper part is in the contact with the cover 11. In order to carrying out this adjustment displacement, an adjustment screw 116 is provided screwed down inside cover 11, and fitted to lower the body 109A. By lowering this body, the valve seat 110A is lowered and consequently also the valve head 111A held by the spring 113A in contact with the seat 110A. As a consequence, the stem 100 is caused to protrude downward from the base 12 by a longer stretch, this causing a corresponding rotation of the double arm lever 94–98 and a shorter interference time of the pivot 92 with the inclined tongue of the arm 94 of this lever during the active working stroke of the plate 21. The end result is a shorter time of action of compressed air inside the blending chamber 24 for jointing the yarns. Compressed air indeed, controlled by the valve inserted inside the bore 104 is due to arrive to the blending chamber 27 through a channel 117 formed inside the prismatic portion 10 and connected at an end to the central blind hole of the upper body 109A, and at the other end, through suitable openings in the cover 11 and in the head 26, to the chamber 27 formed in this head.

The adjustment screw 116 is also active on a pointer 117 to the purpose of indicating its adjusting position.

The sequence of the single steps during an operative cycle driven by the operative stroke of the plates 21 and 22 is as follows: at first, after the two yarns to be jointed have been inserted inside the blending chamber 27, from opposite sides, by devices of the spooler, which are external to the device, and they have been exactly positioned, thanks to the presence of the guide means in the device, the yarns are clamped by means of the clamping means 55–56; subsequently, the blending chamber 27 is closed by the cap 34 and the free extremities of the yarns are cut by means of the cutting means 47–48; the treatment takes place then of the cut free ends of the yarns, which extend outside laterally from the blending chamber, by the compressed air streams fed through the nozzles 114–115; after the end of this treatment of the free ends, the same are introduced inside the blending chamber 27 by the action of the means 66, and at last the very jointing takes place by means of the timed stream of compressed air fed to the chamber 27.

The plates 21 and 22 are then caused to carry out their return stroke, all the components of the device being thus returned to their starting position, without however opening in this stage the inlet valves of compressed air to the pretreatment nozzles and to the blending chamber.

From the disclosure above set forth, the advantages are clearly appearing of the device according to the invention. This device houses within a particularly compact constructional structure, and within reduced overall dimensions, all the mechanical and pneumatic means needed to the purpose of performing the jointing of textile yarns by compressed air, including the means for the pneumatic pretreatment of the ends of the yarns. All mechanical components are extremely simple, and hence suitable to be manufactured by cheap procedures. This is achieved, in particular, thanks to the driving contoured plates, which can be produced without any chip removing working processes, by simple moulding. Moreover, as the two plates are perfectly identical, only one die is required. The use of such plates has made it possible to position the valve body between them, such valve body having a width equal to the length of the blending chamber, thus without requiring additional room.

By the way, the operating steps of the device could be carried out also during the stroke of the driving plates from up downward, instead of during the stroke from down upward. It could be moreover possible to cause the blending chamber to open again still at the end of the operational stroke of the driving plates, rather than during their return stroke. It could be possible then to use to the purpose of driving the opening and closing motion of the cap, a profiled slit in one of the driving plates, rather than the cam profile of the plate itself.

The adjustment means are also noticeable, which are of extreme simplicity, both for the introduction of the yarns end within the blending chamber, and for the during time of the stream of compressed air inside the blending chamber.

I claim:

1. Apparatus for joining the ends of textile yarns by means of compressed air comprising: a body; means on said body defining a blending chamber for receiving the ends of yarns to be joined, said chamber having a longitudinal axis, opposite open ends coaxial with said axis and a longitudinal yarn entry slit extending parallel to said axis, said body having two spaced-apart outside faces which are perpendicular to the longitudinal axis of the blending chamber; a closure cap mounted for movement between positions in which it closes and opens said longitudinal entry slit; clamping means adjacent said slit operable to clamp the ends of yarn; cutting and introducing means adjacent said slit operable to cut yarn ends and to introduce yarns into said slit; pretreatment nozzles adjacent said ends of said chamber; first and second valve means within said body for introducing compressed air from a source thereof into said chamber and into said pretreatment nozzles, respectively; a wall spaced apart from each of said outside faces of said body; guide means on said walls and on said outside faces of said body for positioning the yarns to be joined inside said chamber; a driving plate located between each of said outside faces and the respective wall and means mounting each driving plate for linear reciprocating movement in directions parallel to said walls; and driving connections between said driving plates and said closure cap, said clamping means, said cutting and introducing means and said first and second valve means for operating the same during reciprocating movement of said plates.

2. Apparatus as in claim 1 wherein said first and second valve means for each includes a valve stem extending outside said body and wherein the driving connections between said driving plates and said first and second valve means include first and second double arm levers each rotatably mounted on said body, each of said levers having first and second arms, said second arm of each lever cooperating with one of said valve stems, said driving connection further including a pin protruding from each of said driving plates into said body and cooperating with said first arms.

3. Apparatus as in claim 2 wherein said protruding pins cooperate with an inclined folded tongue of said first arms, wherein said second arms are kept in contact with their respective valve stems by elastic means, the slope of said folded tongues being such that during one stroke of the driving plates, the double arm levers rotate in such a direction as to move the respective valve stem in the direction of valve opening and such that during the opposite stroke of the driving plates, the double arm levers rotate in the opposite direction, in order to perform an idle stroke.

4. Apparatus as in claim 3, wherein the inclined tongue of first arm of the lever associated with the stem of said second valve means is shorter than the inclined tongue of the first arm of the lever associated with the stem of said first valve means.

5. Apparatus as in claim 4 wherein at least the valve controlling the feeding of compressed air to the blending chamber has a valve seat axially adjustable by means of an adjusting screw, against which a valve head solid with the respective stem is kept in contact by elastic means.

6. Apparatus as in claim 1 wherein each driving plate is provided with two profiled slots, one of which drives the cutting means and has two portions, parallel to the moving direction of the plate, positioned at different distances from the center of the plate itself and joined to each other by means of an oblique portion, the second slot driving both the clamping means and the introduction means and having three portions parallel to the moving direction of the plate, placed at different distances from the center of the plate itself, and joined to each other by oblique portions, at least one of the driving plates being additionally provided with a cam profile for driving the cap.

7. Apparatus as in claim 6 wherein said driving plates are identical plates of molded material and are disposed directly opposite each other on opposite sides of said body.

8. Apparatus as in claim 7 wherein said two driving plates are each provided with driving bars extending outward from said body and connected to each other by an element adapted to be connected to an external power source.

9. Apparatus as in claim 6 wherein said clamping means, and said cutting and introduction means have movable parts and are assembled on the walls facing said driving plates, said movable parts being kinematically connected to pivots with driving rollers inserted inside the profiled slots of the plates.

* * * * *